US010987559B1

(12) United States Patent
Hamburger

(10) Patent No.: US 10,987,559 B1
(45) Date of Patent: Apr. 27, 2021

(54) ADJUSTABLE GOLF CLUB

(71) Applicant: Edward Hamburger, Toms River, NJ (US)

(72) Inventor: Edward Hamburger, Toms River, NJ (US)

( * ) Notice: Subject to any disclaimer, the term of this patent is extended or adjusted under 35 U.S.C. 154(b) by 0 days.

(21) Appl. No.: 17/027,273

(22) Filed: Sep. 21, 2020

(51) Int. Cl.

| | |
|---|---|
| ***A63B 53/16*** | (2006.01) |
| ***A63B 60/28*** | (2015.01) |
| ***A63B 60/14*** | (2015.01) |
| ***A63B 53/14*** | (2015.01) |

(52) U.S. Cl.
CPC ..... *A63B 60/28* (2015.10); *A63B 53/14* (2013.01); *A63B 60/14* (2015.10); *A63B 2209/10* (2013.01)

(58) Field of Classification Search
CPC ..... A63B 60/28; A63B 60/14; A63B 53/14; A63B 2209/10
See application file for complete search history.

(56) References Cited

U.S. PATENT DOCUMENTS

| | | | | |
|---|---|---|---|---|
| 2,129,068 | A * | 9/1938 | Reach | A63B 60/00 473/306 |
| 5,374,064 | A * | 12/1994 | Barber | A63B 60/34 473/204 |
| 6,394,909 | B1 * | 5/2002 | Laibangyang | A63B 60/16 473/232 |
| 7,172,514 | B2 * | 2/2007 | Benson | A63B 53/00 473/239 |
| 7,510,482 | B2 | 3/2009 | Benson | |
| 7,582,023 | B2 * | 9/2009 | Hung | A63B 60/16 473/299 |
| 7,798,911 | B2 | 9/2010 | Gill | |
| 8,267,805 | B2 * | 9/2012 | Johnson | A63B 53/14 473/296 |
| 8,425,344 | B2 * | 4/2013 | Evans | A63B 53/12 473/296 |
| 8,641,551 | B2 | 2/2014 | Johnson | |
| 8,740,720 | B2 | 6/2014 | Soracco et al. | |
| 8,814,718 | B1 | 8/2014 | Rollinson et al. | |
| 8,852,019 | B2 | 10/2014 | Evans et al. | |
| 10,500,454 | B2 | 12/2019 | Barker et al. | |
| 10,525,316 | B2 | 1/2020 | Barker et al. | |
| 2002/0091012 | A1 * | 7/2002 | Evans | A63B 60/00 473/296 |

(Continued)

FOREIGN PATENT DOCUMENTS

| | | |
|---|---|---|
| JP | 6340182 B2 | 6/2018 |
| WO | 2002055157 A1 | 7/2002 |

OTHER PUBLICATIONS

JP6340182B2, EPO Machine translation, Publication JP2015080695, Jun. 6, 2018.

*Primary Examiner* — Stephen L Blau
(74) *Attorney, Agent, or Firm* — MacMillan, Sobanski & Todd, LLC

(57) ABSTRACT

A length adjustable golf club includes a club head attached to a shaft at a lower end. A length adjusting kit includes a shaft insert that attaches to the shaft at an upper end. The shaft insert includes a coupling port that accepts one of an extension block or a grip connector. To provide length adjustments of the overall club length, one or more extension blocks may attached between the shaft insert and the grip connector. A grip assembly having a reinforcing sleeve connects to the grip connector and extends over the shaft and any extension blocks.

16 Claims, 10 Drawing Sheets

(56) References Cited

U.S. PATENT DOCUMENTS

| | | | | |
|---|---|---|---|---|
| 2004/0116197 | A1* | 6/2004 | Benson | A63B 53/00 473/239 |
| 2009/0270197 | A1* | 10/2009 | Holtzman | A63B 60/00 473/296 |
| 2013/0109488 | A1 | 5/2013 | Evans | |
| 2014/0121031 | A1 | 5/2014 | Aguinaldo et al. | |
| 2014/0378242 | A1* | 12/2014 | Chalifoux | A63B 60/00 473/299 |
| 2015/0306481 | A1 | 10/2015 | Knutson et al. | |

* cited by examiner

ADJUSTABLE GOLF CLUB

BACKGROUND

Golf clubs are typically manufactured in discrete, varying lengths, to provide a proper fit for different users. For many golfers, different course conditions and topographies create a desire to adjust the club length to provide greater swing accuracy and consistency with the swing used during fairway play. Known length adjustable clubs are either cumbersome and weighty or prone to excessive deflection and stress at extension connection points. Excessive deflections affect both the striking force applied to the golf ball and the orientation of the club striking face to the desired ball striking area, i.e., the "sweet spot." Additionally, distribution of the weight of certain extension devices may be as much of an impediment to accurate swing consistency that an ill-fitting club length. Since the accuracy and consistency of a golf swing is facilitated by a shaft with a controlled and consistent stiffness and weight distribution along the shaft length, there is a need to permit the club length to be varied yet maintain a lower and consistent shaft weight over as much of the shaft length as possible.

These same club characteristics also affect young golfers, more particularly, because their growth rate tends to significantly reduce the usable life of a club with a fixed shaft length. In order to encourage young players and help build their skills, it is important that the shaft length be a proper fit. In many instances, either clubs need to be refitted frequently or new clubs are purchased which makes the sport prohibitively expensive for some players. Thus, it would be beneficial to provide a golf club having an adjustable club length that is not subjected to excessive deflection during a swing event and provides a weight distribution that does not adversely impact club head speed or striking face orientation. It would further be desirable to provide a length adjustable club that is inexpensive to vary the club length yet retains a solid feeling during swing and ball contact events.

SUMMARY

An adjustable golf club comprises a club head, a shaft, and a grip assembly where the grip assembly includes a reinforcing sleeve that is removably secured to the grip connector. The shaft is a hollow, tubular member having a shaft insert fixed to an inner surface of the shaft. The shaft insert includes a coupling port that receives a coupling stud of the grip connector. In one embodiment, the shaft insert is adhesively bonded to the inner surface of the shaft. In another embodiment, the shaft insert is mechanically attached to the inner surface of the shaft. In certain aspects of the invention where length adjustment of the distance between the grip assembly and the club head is desired, at least one extension block is coupled between the shaft insert and the grip connector. In one embodiment of length adjustment, one end of the extension block is threaded to the shaft insert and the other end is threaded to the grip connector. In one aspect of this embodiment, the extension block includes a coupling stud that threads into a coupling port of the shaft insert and a coupling port that threads over a coupling stud of the grip connector. In another embodiment of length adjustment, the at least one extension block is disposed between the shaft insert and the grip connector. The extension block includes a through-bore that passes over a coupling stud of the grip connector.

The reinforcing sleeve extends over the at least one extension block and over at least a portion of the shaft insert.

The reinforcing sleeve includes an open proximal end, a tubular mid-section, and a distal end having a threaded section. The threaded section defines a diameter that is smaller than an inner diameter of the tubular mid-section. In one embodiment, the reinforcing sleeve is a single piece tubular member having a threaded section, that mates with a corresponding threaded interface of the grip connector, is formed into a wall section of the tubular member and defines a thread pitch in a range of 4 to 6 threads per inch. In one aspect of this embodiment, the reinforcing sleeve is one of a blow-molded plastic member or an aluminum tubular member with the threaded section formed by a cold forming process. In another embodiment, the reinforcing sleeve is a two piece member, where the distal end comprises a cup having threads formed on an inner diameter and the cup attached to a hollow section. The reinforcing sleeve is configured to carry a grip cover. The outer grip cover is applied over an outer surface of the reinforcing sleeve. In one embodiment, the outer grip cover is molded over the outer surface of the reinforcing sleeve. In an alternative embodiment, the outer grip cover is adhesively attached to the outer surface of the reinforcing sleeve.

Various objects and advantages of the adjustable golf club shaft extension will become apparent to those skilled in the art from the following detailed description of the preferred embodiment, when read in light of the accompanying drawings.

DETAILED DESCRIPTION OF THE INVENTION

Figure 1:
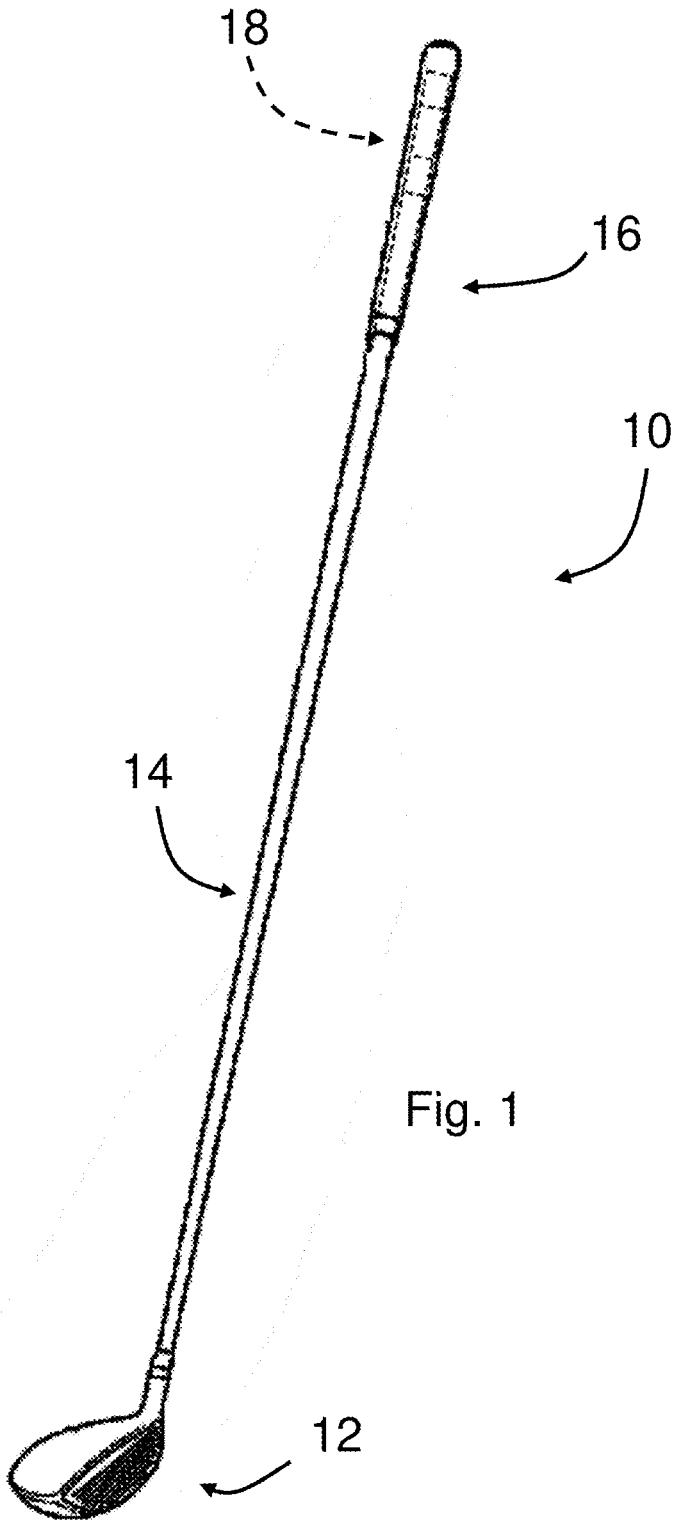
FIG. 1 is a perspective view of an adjustable golf club in accordance with the invention.
Figure 2:
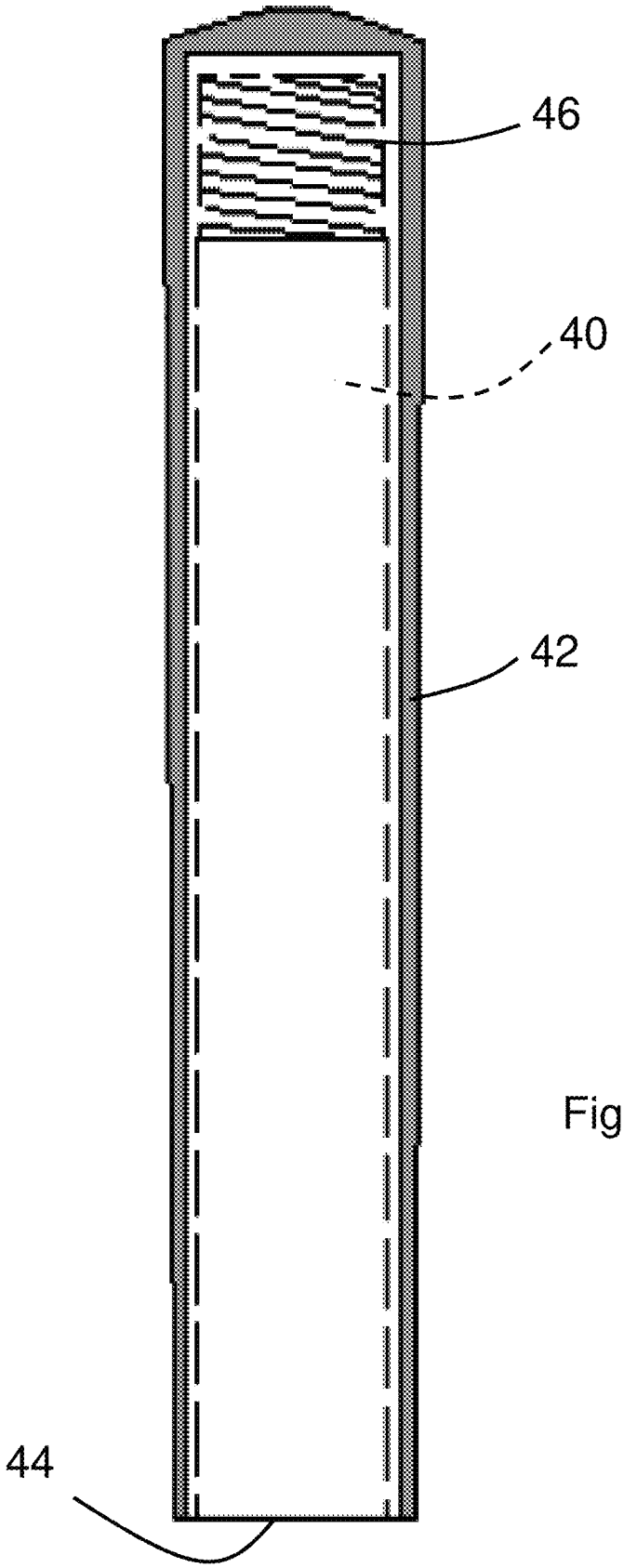
FIG. 2 is an elevation view, in cross-section, of a grip assembly of the adjustable golf club of FIG. 1.

Referring now to FIG. 1, an adjustable golf club (hereafter "golf club") is shown generally at 10. While shown and described in the context of a golf club configured as a driver, the invention is applicable to any golf club, such as a putter, an iron, a wedge, a sand wedge, a chipping wedge, a hybrid club or any other form of club used in the game of golf. The golf club 10 includes a head 12, a shaft 14, and a grip assembly 16. The head 12, as indicated above, may be a head configured for use in any type of golf club. In the illustrated embodiment, the head 12 is fixed to the shaft 14 in a conventional manner, though the head or any of its parts may be configured as removable. The shaft 14 is a generally hollow, tubular member formed from any suitable material such as steel, aluminum, titanium, carbon fiber, composite, or other materials. Alternatively, the shaft 14 may be solid or have a solid core of a separate material.

Figure 5A:
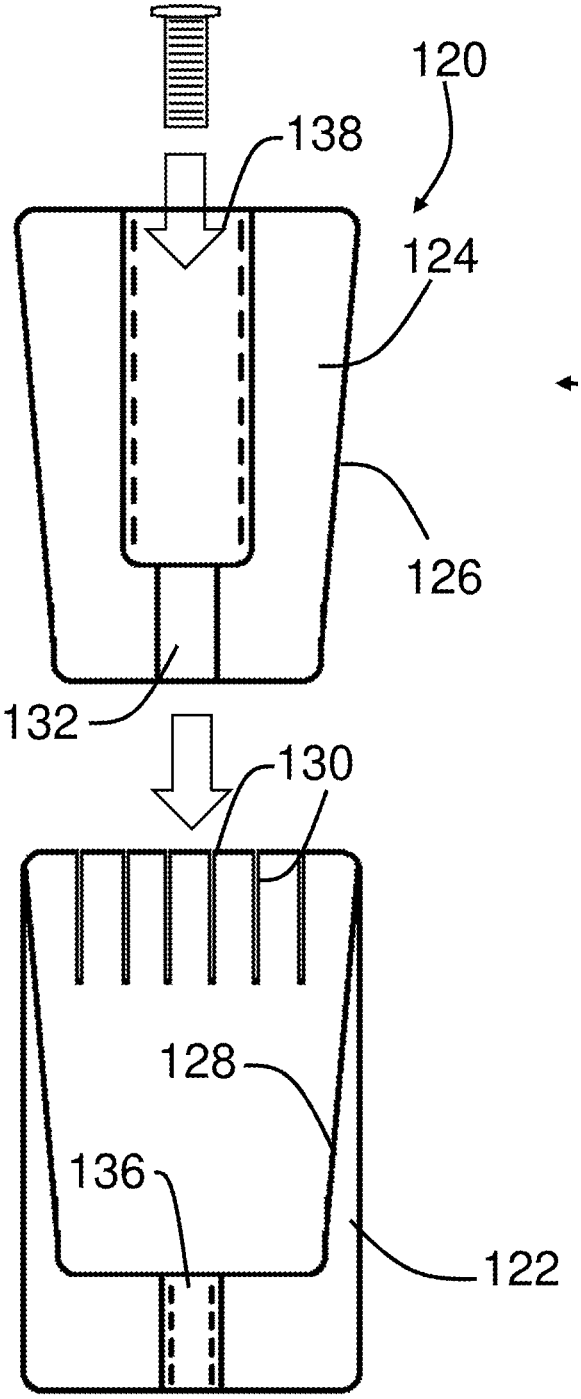
FIGS. 5A-5B are elevation views, in cross-section, of an alternate embodiment of a shaft insert for the adjustable golf club.
Figure 5B:
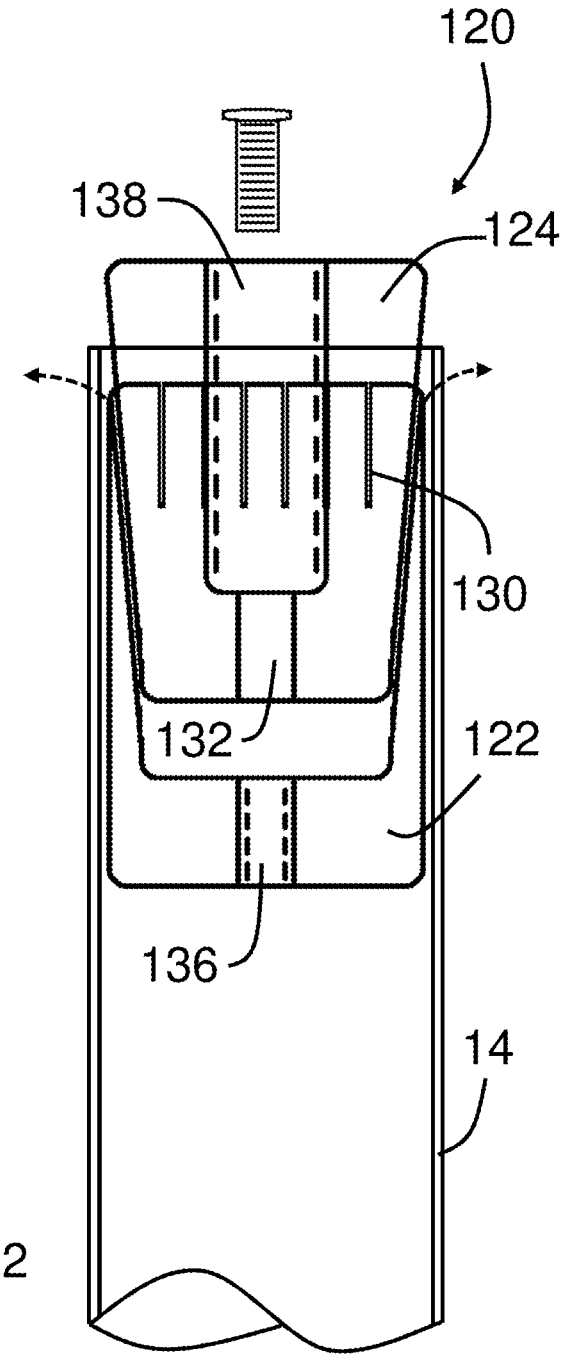

A length adjustment kit 18 includes a shaft insert 20 that is attached to the shaft 14. In the illustrated embodiment of FIGS. 1 and 3, the shaft insert 20 is attached to the shaft inner diameter. In one embodiment, the shaft insert 20 has an outer surface that is adhesively bonded to the shaft inner diameter. Alternatively, the shaft insert may be configured as a cup that locates and attaches to the shaft outer diameter. The outer surface of the shaft insert 20 may be smooth, knurled, serrated, or any surface that facilitates fixed attachment to the shaft 14. As shown in FIGS. 5A and 5B, a shaft insert 120 may be mechanically coupled to the shaft, as will be described below. The shaft insert 20 includes a coupling port 22, illustrated as a threaded bore. The coupling port 22 may have any type of connection feature, threaded, tapered, quick release, and the like, that can accept and retain a mating length extension block 24. The length extension block 24 includes a coupling stud 26 that mates with the coupling port 22 to fix the components together. In the illustrated embodiment, the coupling port 22 and the coupling stud 26 are configured to be threaded together. The extension block 24 includes a coupling port 28 that may be the same as coupling port 22 and configured to engage another extension block 24 to provide incremental length variations of the golf club 10. The extension block 24 is illustrated having a smooth outer surface though such is not required.

Figure 3:
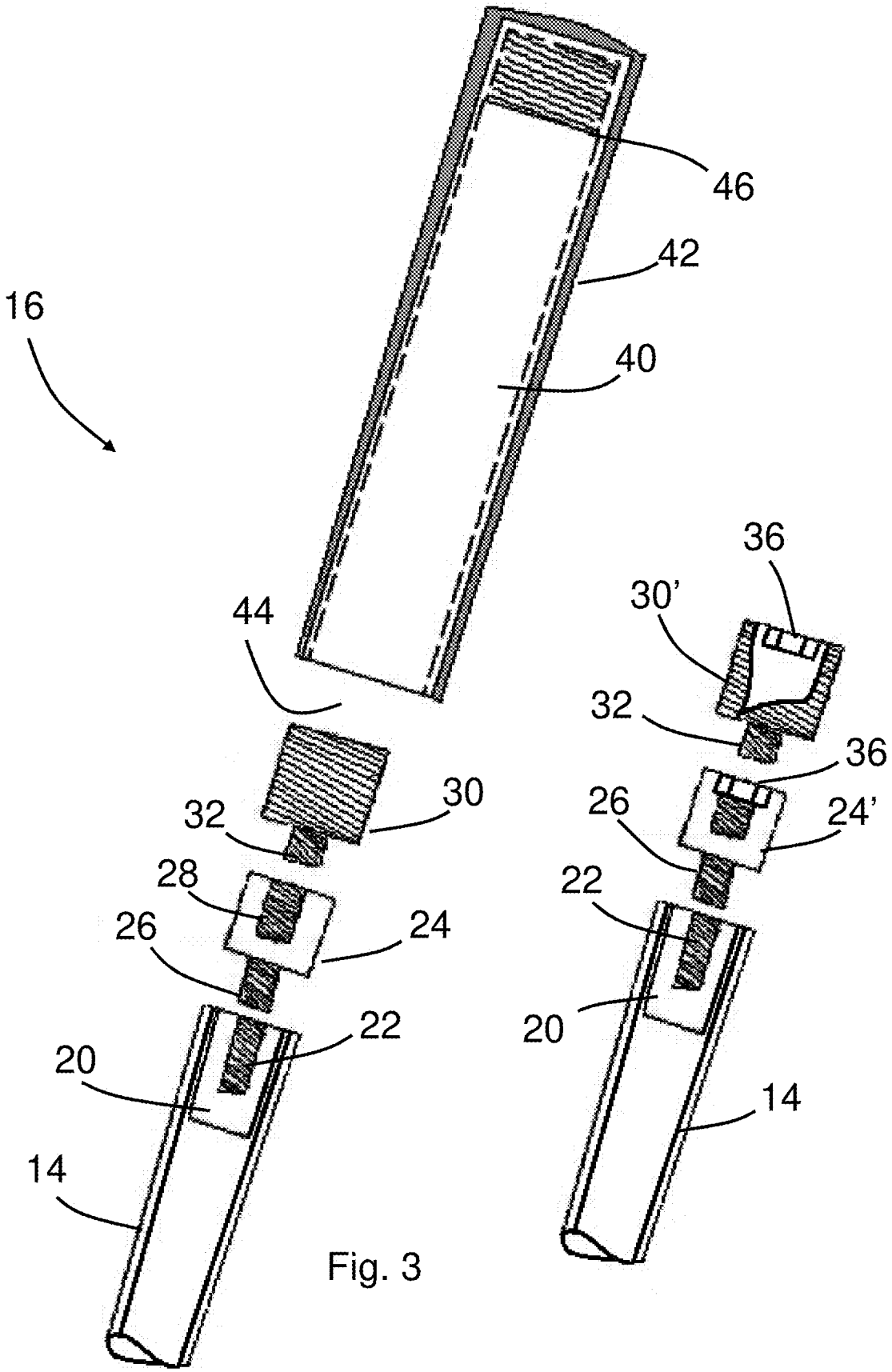
FIG. 3 is an exploded view, in cross-section, of the grip assembly of FIG. 2 and a shaft, shaft insert, shaft extension, and threaded connector of the adjustable golf club of FIG. 1.

The shaft insert 20 or the last attached extension block 24 accepts a grip connector 30. The grip connector 30 includes a coupling stud 32, similar to coupling stud 26, which is configured to mate with coupling port 22 or 28. The grip connector 30 has an outer surface 34 that secures the grip assembly 16 to the shaft 14. In the illustrated embodiment, the outer surface 34 is a threaded surface and may be any type of thread profile. As shown in FIG. 3, extension block 24' and grip connector 30' may include a tool relief 36 formed into the end of the elements to permit tightening or removal from the shaft insert 20. In the illustrated embodiment, the tool relief 36 is configured as a hexagonal opening that can accept an Allen wrench, though any torque transmitting profile may be used such as, for example, a Phillips head, slotted head, Torx®, square, and the like that accepts a mating tool. Alternatively, a portion of the outer surface may be configured to accept a wrench, socket, or other tool to tighten the elements together.

Figure 4:
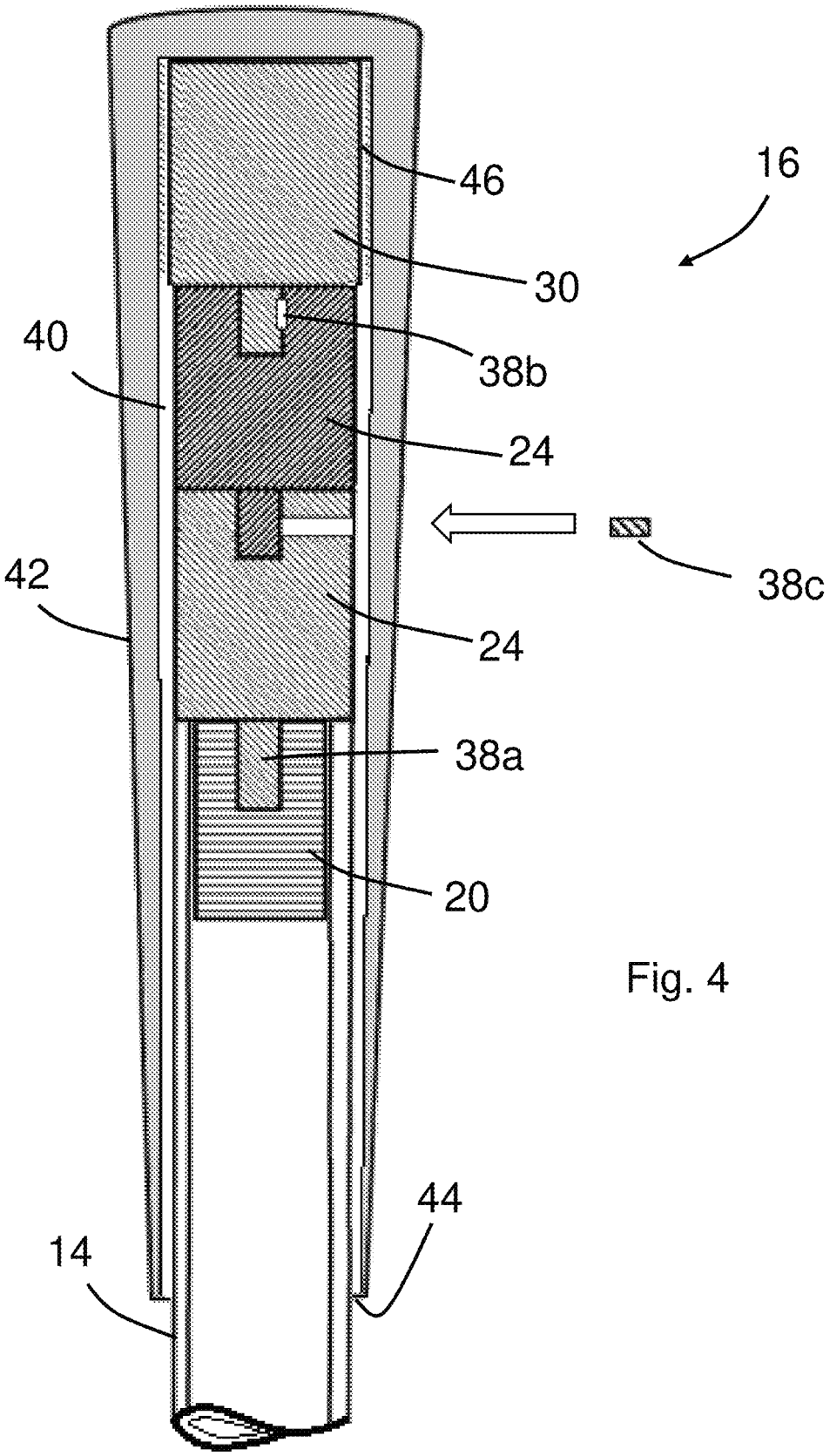
FIG. 4 is an elevation view, in cross-section, of another embodiment of a reinforcement of the adjustable golf club of FIG. 1.

As shown in FIG. 4, the shaft insert 20, extension block 24, and grip connector 30 are assembled together to form the desired length of the golf club 10. The threaded embodiments of the coupling ports and coupling studs are screwed together and may include structures or methods to provide a prevailing torque level to prevent unintended disassembly of these elements. In one aspect of the invention, the ports and stud threads may include locking elements on at least one thread such as, for example, upset threads 38*a*, a lock patch 38*b*, nylon patch or ring applied to one of the port or stud, or a locking set screw 38*c* that extends through the coupling to the threads of the coupling stud 26 or 32 to prevent unintended loosening. The grip assembly 16 includes a reinforcing sleeve 40 that carries an outer grip cover 42. The reinforcing sleeve 40 has an open proximal end 44 that accepts the shaft and coupling assemblies and a distal end 46, illustrated as a threaded section, that mates with the grip connector 30. The threaded section 46 defines a major diameter A that is smaller than an inner diameter B of a hollow, tubular mid-section of the reinforcing sleeve 38, as shown with reference to the embodiment of FIG. 7B. Like the extension block 24 and grip connector 30, the reinforcing sleeve 40 may include a torque transmitting profile to facilitate attachment. The reinforcing sleeve 40 slides over the assembled extension block 24 and grip connector 30 and may also extend over a portion of the outer diameter of the shaft 14. In one embodiment shown in FIG. 4, the reinforcing sleeve 40 contacts the outer surfaces of the extension block 24 and shaft 14 to distribute the loads applied from swinging the club and impacting the golf ball in order to prevent loosening of the connections.

An alternative embodiment of the shaft insert 120, is shown in FIGS. 5A and 5B. As described above, the shaft insert 20 is bonded to the shaft. The shaft insert 120, as shown in FIGS. 5A and 5B, is mechanically attached to the shaft 14 by means of an expanding taper that forces the outer surface of an outer cup 122 against the inner surface of the shaft 14. An inner wedge 124 has a tapered outer surface 126 that mates with an inner tapered surface 128 of the cup 122. The cup 122 may further include one or more kerfs or slits 130 to permit the cup 122 to more easily expand outwardly as the wedge 124 is drawn into the cup. The wedge 124 may include a bore 132 that permits an attaching screw 134 to engage a mating threaded opening 136 to draw the wedge into the cup. The bore 132 is illustrated at the bottom of a coupling port 138 that engages the coupling studs of the extension block 24 or the grip connector 30. The shaft insert 120 may be removable so that the length adjustment and grip assembly features may be moved from one shaft and head sub assembly to another.

Figure 6:
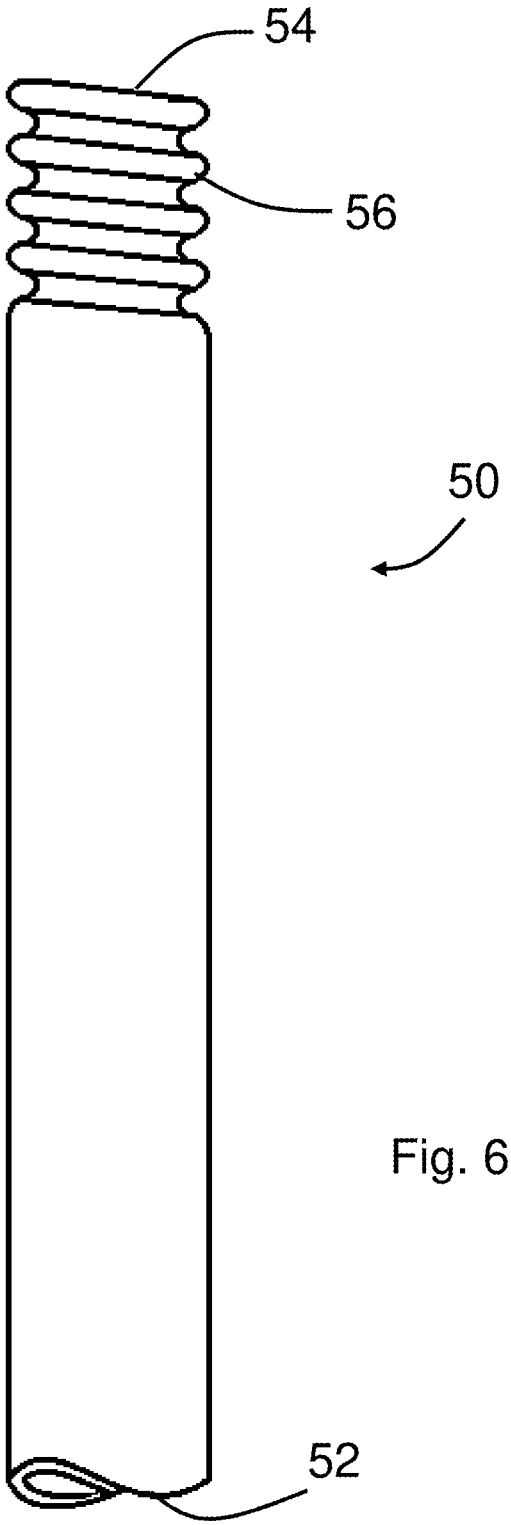
FIG. 6 is an elevation view of a reinforcement sleeve, according to another embodiment of the invention.

Referring now to FIG. 6, there is illustrated another embodiment of a reinforcing sleeve, shown generally at 50. The reinforcing sleeve 50 includes an open or proximal end 52 and a threaded or distal end 54. In the illustrated embodiment, the reinforcing sleeve 50 is formed from a tubular starting stock that may be open on both ends. The threaded end 54 has threads 56 formed into the tubing by cold forming or cold working, upset forming, stamping, magnetic pulse forming, or any suitable cold or warm forming process if the tubing is made from a metal. Alternatively, the tubing may be a plastic or polymer and may be injection molded, blow molded, or 3-D printed and may include any type of reinforcing fibers or mats. The threads 56 may have any desired profile and are shown as a course thread form, similar to a broom handle or paint roller extension handle connection of approximately 4-6 threads per inch, though more threads of a finer pitch may be used, if desired. The reinforcing sleeve 50 may be used in conjunction with a standard grip cover, such as grip cover 42. Alternatively, the reinforcing sleeve 50 may be an insert in a grip molding die to form a single, over-molded grip 58 as shown in FIG. 9.

Figure 7A:
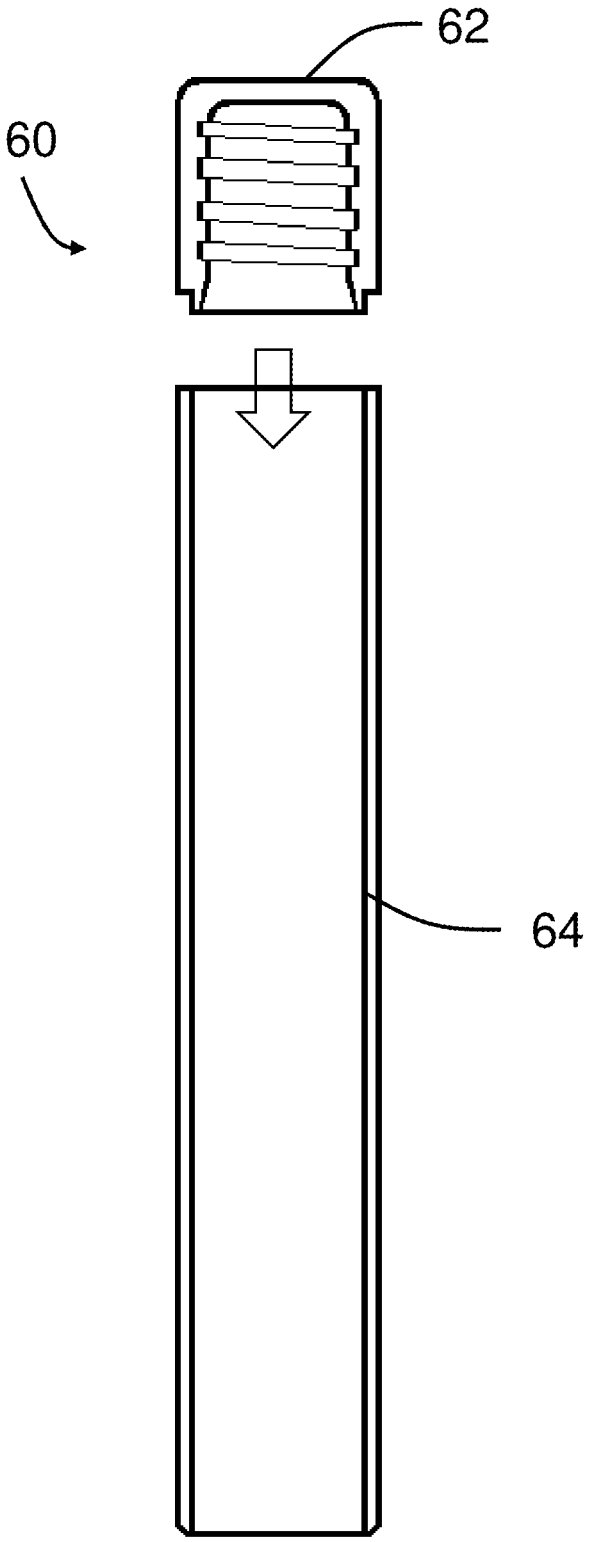
FIG. 7A is an exploded, elevation view, in cross-section, of a reinforcement sleeve, according to another embodiment of the invention.
Figure 7B:
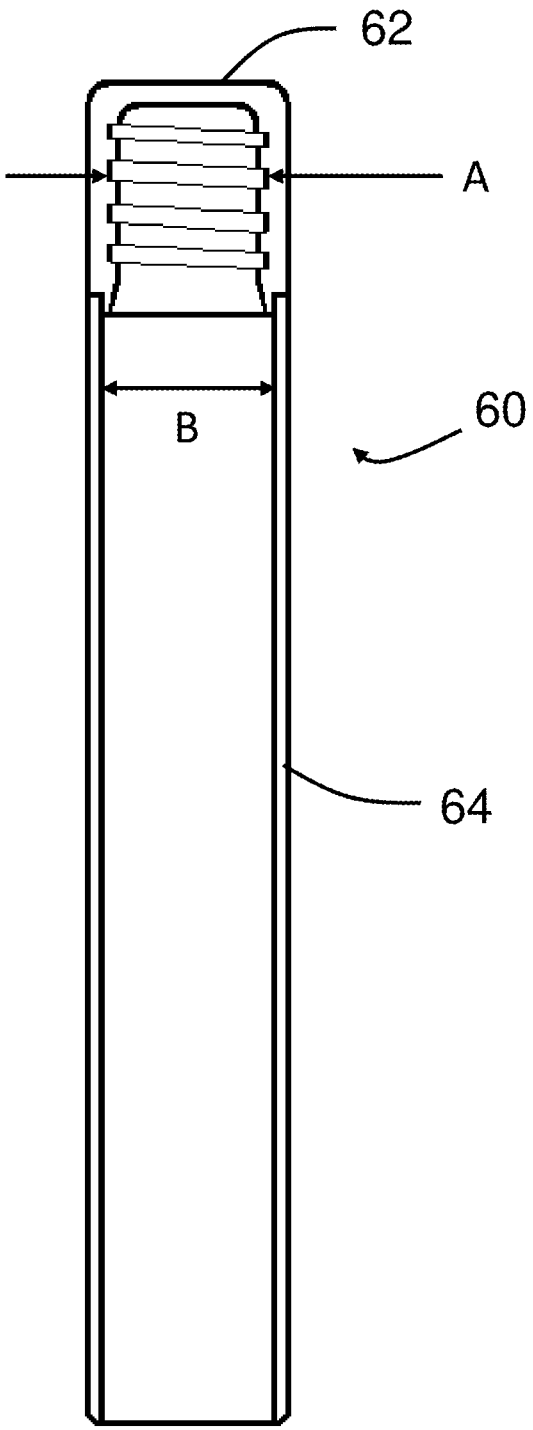
FIG. 7B is an elevation view, in cross-section, of the reinforcement sleeve of FIG. 7A.

Referring now to FIGS. 7A and 7B, another embodiment of a reinforcing sleeve, shown generally at 60, is configured as a two piece subassembly, having a grip attachment cap 62 and a tubular sleeve body 64. The cap 62 may be a machined component or may be formed by a net forming process such as, for example, sintered metal processing, plastic injection molding, cold forming, or casting. The sleeve body 64 may be bonded, adhesively attached, friction welded, chemically welded, threaded, or welded by any process to fuse the cap to the sleeve.

Figures 8A, 8B, 9:
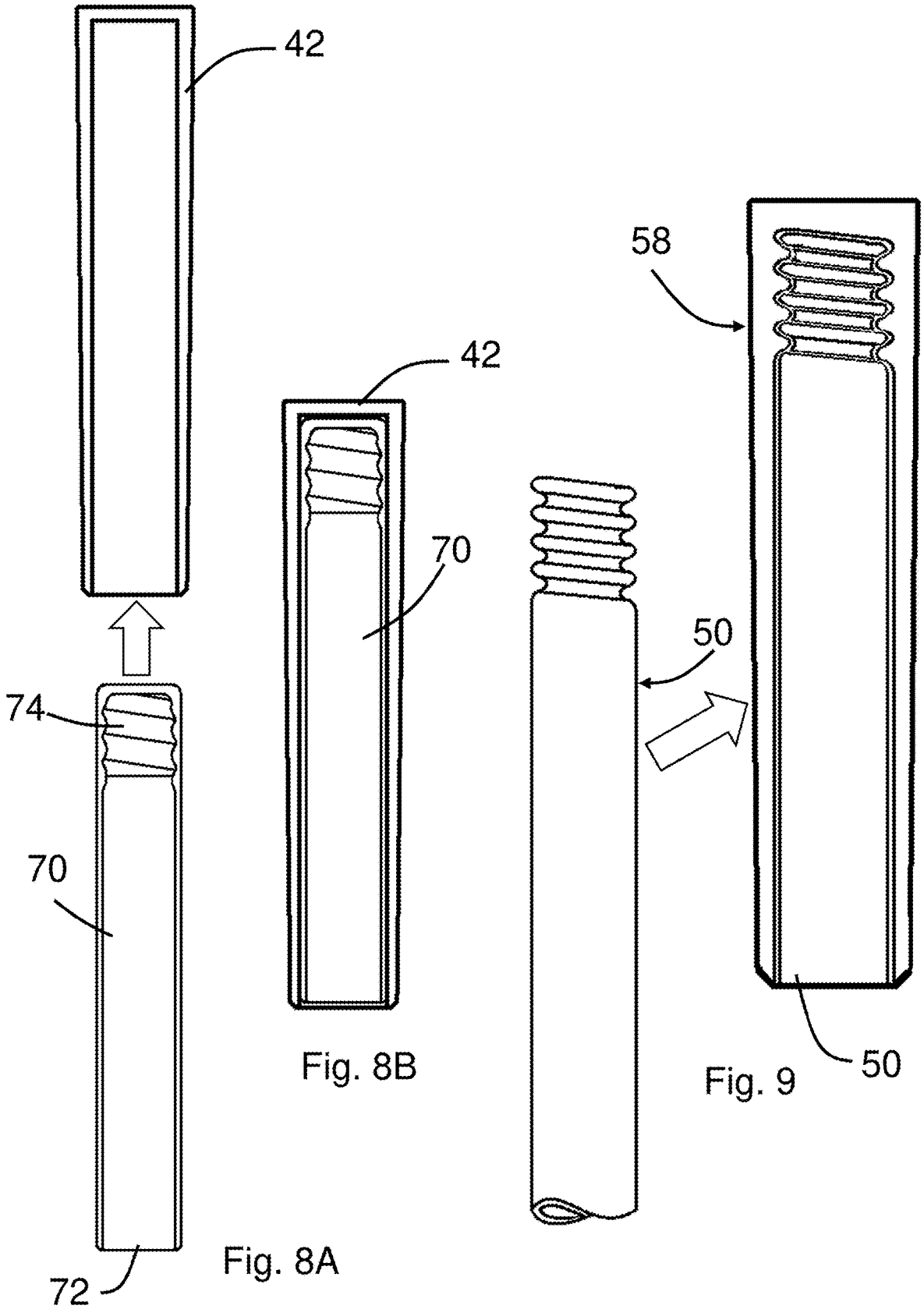
FIG. 8A is an exploded, elevation view, in cross-section, of a grip assembly in accordance with the invention.
FIG. 8B is an elevation views, in cross-section, of the assembled grip assembly of FIG. 8A.
FIG. 9 is an elevation view, in cross-section, of the reinforcement sleeve of FIG. 6 molded into an embodiment of a grip assembly in accordance with the invention.
Figure 10:
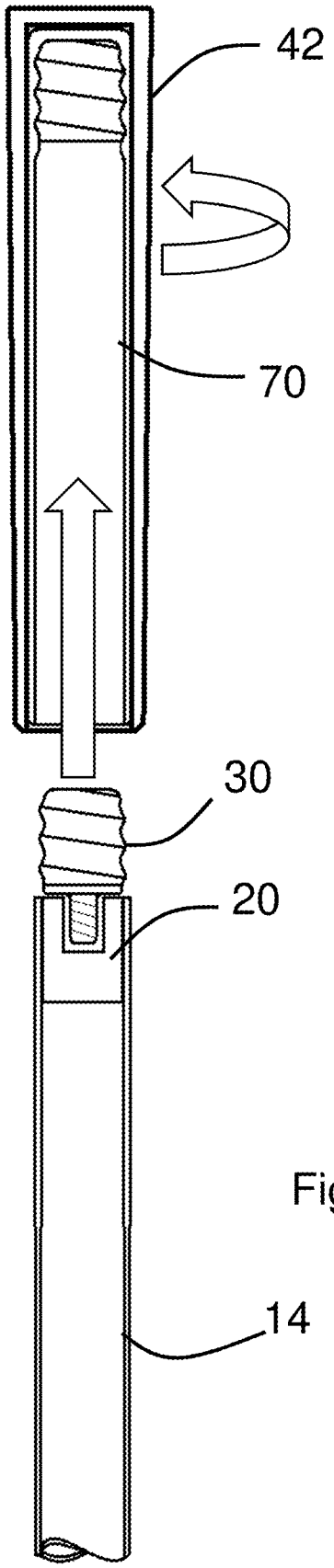
FIG. 10 is a schematic illustration, in cross-section, of the installation of a shaft having a shaft insert and a threaded connector into the reinforcement sleeve and grip assembly of FIG. 8B.

Referring now to FIGS. 8A and 8B, a reinforcing sleeve 70 is configured as a single piece structure having an open proximal end 72 and a threaded distal end 74. A conventional grip 42 is assembled over the reinforcing sleeve 70 in a conventional manner that may include use of an adhesive tape and solvent to effect assembly and bonding. Alternatively, the grip may be configured as a tape (polymer, leather, cloth, or any material) that may be wound around or applied onto the reinforcing sleeve 70. This permits a user to apply any desired grip cover onto the length adjustment kit, such as length adjustment kit 18. As shown in FIG. 10, the resulting shaft, shaft insert, extension blocks (if any), and grip connector are inserted into the grip assembly 16 and tightened onto the shaft to form the adjustable golf club. Any of the torque prevailing features described above may be used to prevent loosening of the grip assembly from the grip connector.

Figure 11:
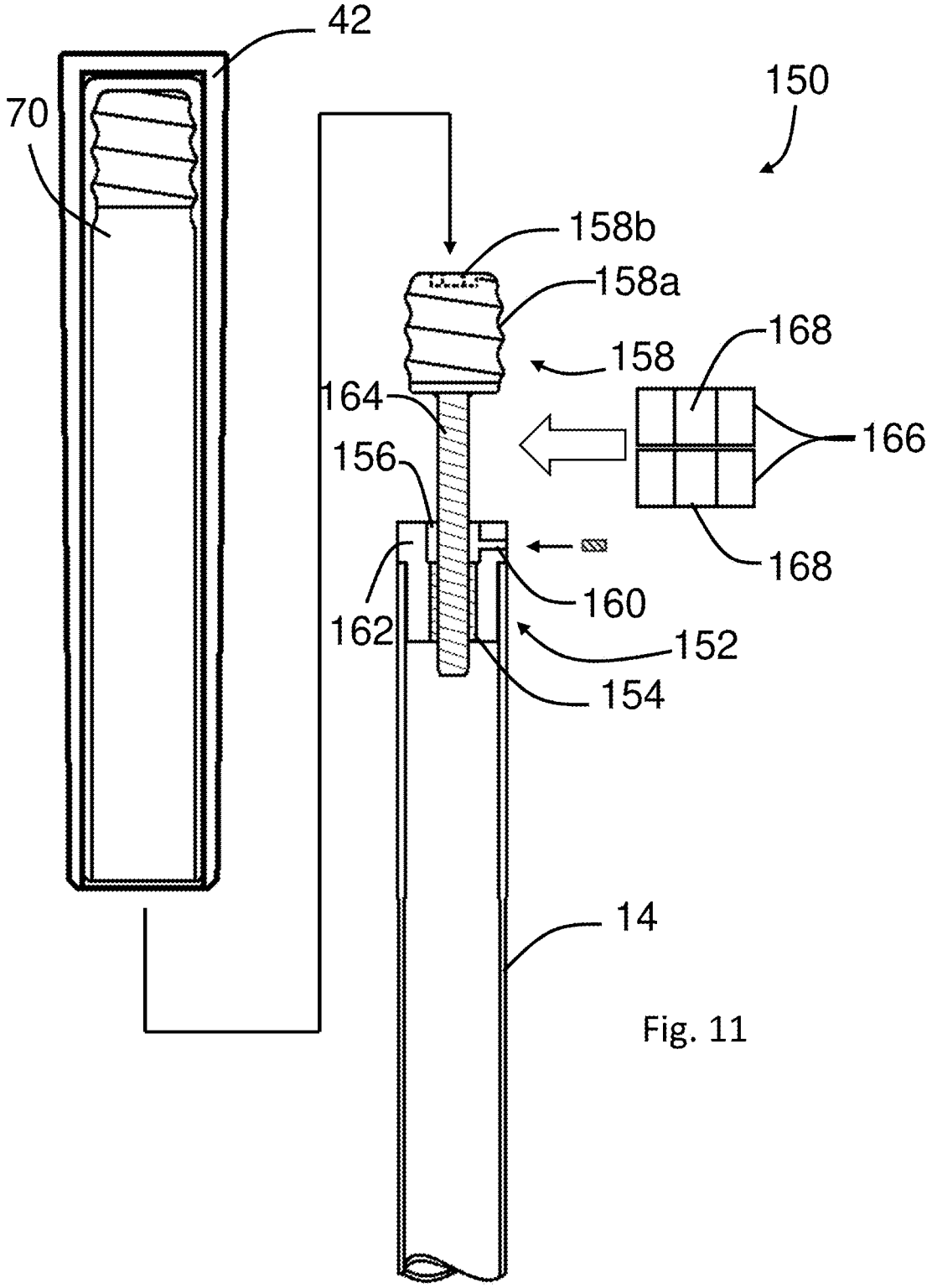
FIG. 11 is a schematic illustration, in cross section, of a grip assembly, shaft and length adjustment kit in accordance with another embodiment of the invention.

Referring now to FIG. 11, there is illustrated another embodiment of a length adjustable golf club, shown generally at 150. The adjustable golf club 150 includes a shaft insert 152 attached to the club shaft 14 in any suitable manner such as those described above. The shaft insert 152 includes a threaded aperture 154 that extends through the shaft insert 152 and may include a lead-in counterbore or chamfer 156 to facilitate installation of an alternative embodiment of a grip connector, shown generally at 158. The shaft insert 152 may optionally include a set screw bore 160 formed through a shoulder 162 of the shaft insert 152 to accept a locking set screw similar to set screw 38*c*. The grip connector 158 includes a coupling stud 164 that may be threaded along an entire length or a portion of the stud length. The threaded coupling stud 164 engages the threaded aperture 154 to secure the grip connector 158 to the shaft insert 152. One or more extension blocks 166, each having a through-bore 168 may be inserted between a grip interface 158*a* of the grip connector 158 and the shaft insert 152 to create a solid length extension connection, if so desired. The coupling stud 164 is configured to pass through the through-bores 168. The grip connector 158 may also include a tool relief 158*b*, similar to tool relief 36 described above to tighten the length adjustment connection.

The reinforcing sleeve 40, and the various embodiments and variations, provides a strengthening and load distribution function in response to shock loads experienced by the coupled length adjustment kit elements that assists in preventing undesired loosening of the connections. In addition, the ability of the grip assembly 16 to house the length adjustment kit 18 and its elements permits the associated weight of the components to be concentrated in the golfer's hands. This weight location permits the stiffness and damping characteristics of the shaft 14 to remain as intended without an undue influence of shortening the shaft tubing, threaded connections, and weight concentrations of the adjustment components. Since a golf swing is generally considered to be two superimposed pendulum motions, one pivoted about the back, through the hips and shoulders, and the other pivoted about the wrists, concentrating any additional weight in the grip area permits the kinetic energy generation from the head acting through the swing arc to be dominated by the head weight. This permits the length adjustment to be more independent from the kinetic design aspects of the club, thus simulating more closely a club having a longer tubular shaft segment.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An adjustable golf club comprising:

a club head;

a shaft having a shaft insert supporting a grip connector; and a grip assembly having a reinforcing sleeve, the reinforcing sleeve configured to be removably secured to the grip connector, and including an open proximal end, a tubular mid-section, and a distal end having a threaded section, the threaded section defining a diameter that is smaller than an inner diameter of the tubular mid-section, the reinforcing sleeve being a two piece member wherein the distal end comprises a cup having threads formed on an inner diameter, the cup attached to a hollow section.

2. The adjustable golf club of claim 1 wherein the shaft is a hollow, tubular member and the shaft insert is fixed to an inner surface of the shaft, the shaft insert having a coupling port that receives a coupling stud of the grip connector.

3. The adjustable golf club of claim 2 wherein the shaft insert is adhesively bonded to the inner surface of the shaft.

4. The adjustable golf club of claim 2 wherein the shaft insert is mechanically attached to the inner surface of the shaft.

5. The adjustable golf club of claim 1 wherein at least one extension block is coupled to the shaft insert and the grip connector is coupled to the extension block, and the reinforcing sleeve extends over the at least one extension block and over at least a portion of the shaft insert.

6. The adjustable golf club of claim 5 wherein the extension block includes a coupling stud that engages the shaft insert.

7. The adjustable golf club of claim 6 wherein the extension block includes a coupling port that engages a coupling stud extending from the grip connector.

8. The adjustable golf club of claim 1 wherein at least one extension block is disposed between the shaft insert and the grip connector, the extension block includes a through-bore that passes over a coupling stud of the grip connector.

9. The adjustable golf club of claim 1 wherein the threaded section defines a thread pitch in a range of 4 to 6 threads per inch.

10. The adjustable golf club of claim 1 wherein the threaded section of the cup is formed by a cold forming process.

11. The adjustable golf club of claim 1 wherein the grip assembly includes an outer grip cover that is applied over an outer surface of the reinforcing sleeve.

12. The adjustable golf club of claim 11 wherein the outer grip cover is molded over the outer surface of the reinforcing sleeve.

13. The adjustable golf club of claim 11 wherein the outer grip cover is adhesively attached to the outer surface of the reinforcing sleeve.

14. The adjustable golf club of claim 1 wherein the cup is attached to the hollow section to form the reinforcing sleeve by a fusing process.

15. The adjustable golf club of claim 14 wherein the cup is fused to the hollow section by one of adhesive bonding, friction welding, welding, or threading.

16. The adjustable golf club of claim 1 wherein the cup is one of a machined component, or a net-formed component.

* * * * *